United States Patent [19]

Dennis

[11] 4,357,773

[45] Nov. 9, 1982

[54] DISPLAY SIGN

[75] Inventor: Ashley A. Dennis, St. Lambert, Canada

[73] Assignee: RLD Industries Ltd., Ottawa, Canada

[21] Appl. No.: 189,764

[22] Filed: Sep. 23, 1980

[30] Foreign Application Priority Data

Apr. 24, 1980 [CA] Canada ..... 350642

[51] Int. Cl.[3] ..... G09F 7/02

[52] U.S. Cl. ..... 40/618; 40/607

[58] Field of Search ..... 40/152, 156, 618, 605; 52/76

[56] References Cited

U.S. PATENT DOCUMENTS

| | | | |
|---|---|---|---|
| 3,208,170 | 9/1965 | Madey | 40/618 |
| 3,230,652 | 1/1966 | McNair | 40/152 |
| 3,327,414 | 6/1967 | Hill | 40/617 |
| 3,458,945 | 8/1969 | Edwards | 40/618 |
| 4,053,008 | 10/1977 | Baslow | 52/476 |
| 4,138,787 | 2/1979 | Sarkisian | 40/618 |
| 4,187,630 | 2/1980 | Giulie et al. | 40/156 |

*Primary Examiner*—Gene Mancene
*Assistant Examiner*—Wenceslao J. Contreras
*Attorney, Agent, or Firm*—Richard J. Hicks; Stanley E. Johnson

[57] ABSTRACT

An improved display sign of the type in which interchangeable indicia can be mounted on both sides, and comprising a plurality of aluminum slats surrounded by an extruded aluminum frame. Each longitudinal edge of each slat is provided with a longitudinally extending hook to interlock with a similar hook on the next slat or, in the case of the top and bottom slats, with a projection integrally formed in a recess in the frame member. The slats are locked into the top and bottom frame members by means of a removable rod extending longitudinally thereof in a complementary shaped channel in the recess in the frame member.

6 Claims, 4 Drawing Figures

DISPLAY SIGN

This invention relates to a display sign and more particularly to improvements in display signs which are adapted to receive interchangeable indicia on one or both opposed faces thereof.

Display signs of the above general type are well known to the art and are generally formed by assembling, within a rectangular frame, a series of identical slats in abutting edge to edge relationship. The opposite faces of each slat are each provided with a longitudinally extending flange on which clips hooked on the back of individual letters or the like are received, or between pairs of which flexible indicia strips or the like can be received. Typical examples of the prior art are described, for example, in Canadian Pat. No. 937,754 issued Dec. 4, 1973 to Finkel and in Canadian Pat. No. 763,169 issued July 18, 1967 to Edwards. In the earlier of these patents the slats are interconnected along the abutting edges by a relatively simple tongue and groove joint which, while locating the slats, does not rigidly retain them. While such a system provides reasonable stability and resistance to displacement from one side by such causes as vandalism and wind pressure, there is little stability or resistance from the other side. A more positive interlocking system is provided in the later patent referred to above so that under normal wind loading circumstances the sign is stable and wind resistant from both sides. The later patent requires, however, a relatively heavy cross section and stiffening members to provide the necessary stability and due to its inherently flexible nature there still remains the risk that the combination of the slats can flex sufficiently, under heavy wind loads, to slip out of the peripheral frame.

It is, therefore, an object of the present invention to provide an improved sign which overcomes the problems of the prior art, is lighter in construction and thus saves on material costs, and which is provided with simple but positive interlocking between individual slats and between the slats and the peripheral frame.

Thus by one aspect of this invention there is provided a display sign comprising:

(a) a rigid peripheral frame having a first channel extending around the inner periphery thereof;

(b) a plurality of parallel slats interconnected along their adjacent marginal edges, the outer peripheral edge of said interconnected plurality of slats projecting into the channel of the peripheral frame; and (c) means interlocking the peripheral marginal edges of said interlocked slats, parallel the interlocked marginal edges thereof, into said channel, whereby lateral forces on the face of the sign are transferred from one slat to another and to the peripheral frame.

The invention will be described in more detail hereinafter with reference to the drawings in which.

Figure 1:
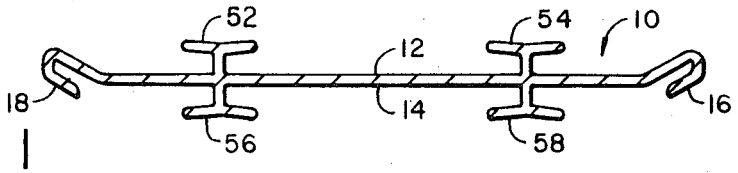
FIG. 1 is a cross section of interlocking slats according to one embodiment of the present invention.

Referring firstly to FIG. 1, there is shown one of a plurality of interlocking slats 10, all of which are identical in shape, and which have opposed faces 12,14 alternately used as front and rear faces respectively, and upper and lower hook ends 16,18 respectively each having an open side or longitudinally extending channel adjacent face 14. Each slat is provided, on each face 12,14 thereof with a pair of spaced apart parallel rails 52,54, and 56,58 respectively, which are integrally formed with the slat and parallel the parallel upper and lower marginal edges of the slat. Each rail comprises a flange portion and a rib portion connecting the flange to the slat.

Any two vertically spaced apart front rails or back rails, either on one particular slat or selected from rails on different slats, may be used to support indicia therebetween, so that the same or different advertising or the like may be displayed, at the same or different heights using the same or differently sized indicia, on both sides of the panel formed by a plurality of slats, interconnected with each other in abutting longitudinal relation by interlocking alternate hook ends 16 and 18 of adjacent slats placed alternately in front and obverse relationship to each other.

Figure 2:
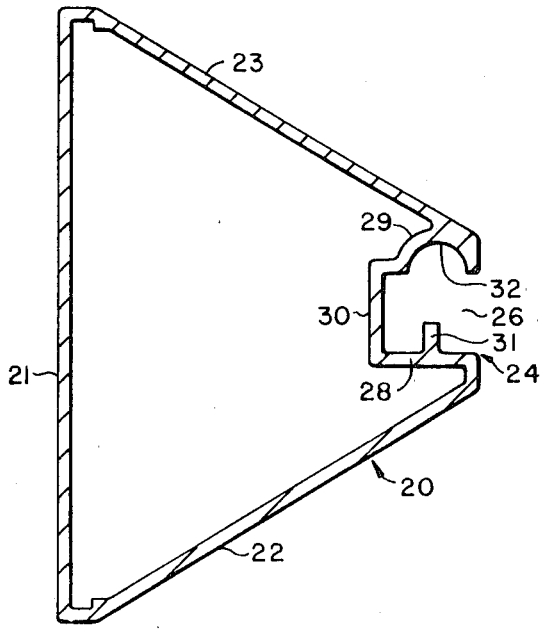
FIG. 2 is a cross section of a peripheral frame member of one embodiment of the present invention.

The peripheral edges of the sign are provided with a hollow substantially triangular cross section frame member 20, as shown in FIG. 2, having a longitudinally extending top wall 21 and inwardly sloping side walls 22,23, preferably but not necessarily extruded in a conventional aluminum alloy material. The apex 24 of the triangular section is provided with a channel 26 extending lengthwise of the frame section, and bounded by inwardly projecting walls 28 and 29 and an interconnecting base wall 30. Wall 28 is provided with a projection 31, perpendicular thereto and extending into recess 26. Wall 29 is provided with a recess 32, preferably but not necessarily semi-circular, for a reason which will be made apparent hereinafter. The width of recess 26 is sufficient to receive projections 52,56 of a slat 10.

Figure 3:
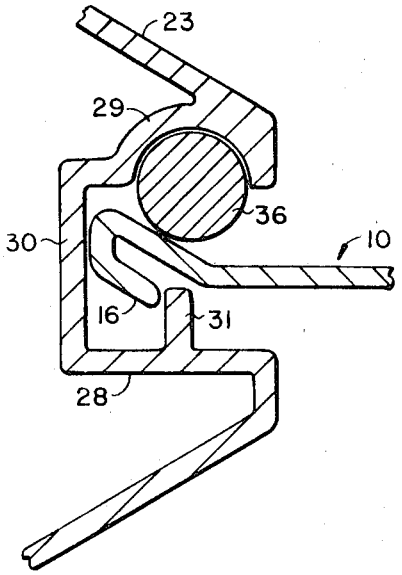
FIG. 3 is an enlarged cross section of the peripheral frame of FIG. 2 showing a slat of FIG. 1 interlocked therewith.
Figure 4:
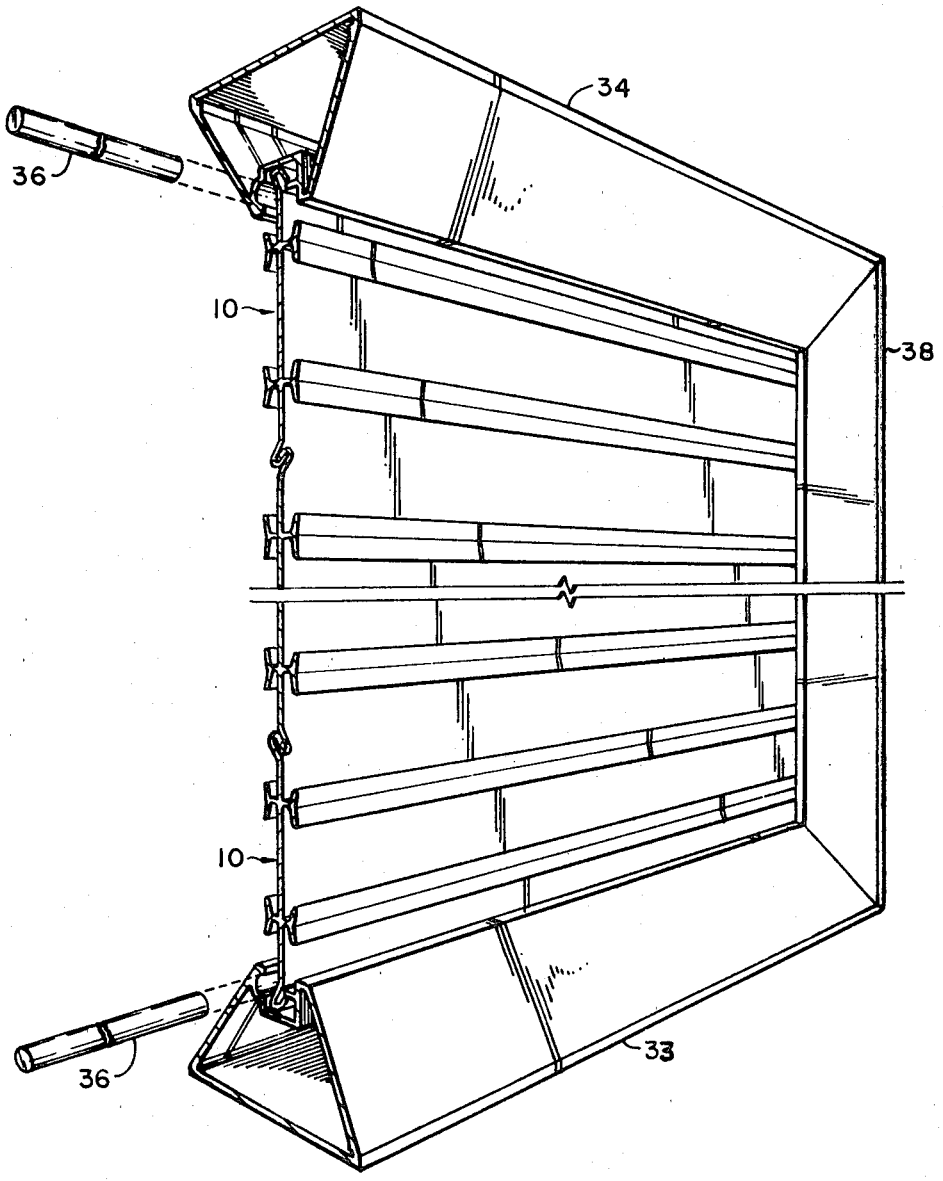
FIG. 4 is a perspective view of a part of a display sign of the present invention utilizing the slats and frame section shown in FIGS. 1 and 2 respectively.

To assemble a sign according to the present invention, a plurality of slats of a selected length are interconnected as hereinbefore described in interlocking and side-by-side relationship as shown in FIG. 4. The hooks 16 and 18 at the lower and upper marginal edges respectively, as shown in FIG. 4, are inserted in respective recesses 26 of lower and upper frame sections 33 and 34, so that hooks 16 and 18 engage with a respective projection 31, as shown more clearly in FIG. 3. A rod 36, preferably but not necessarily circular, is inserted in a complementarily shaped recess 32 from one end thereof so as to lock hook 16 under projection 31 and thus prevent removal of slats 10 from the upper and lower frame members, as shown in FIG. 3. The side frame members 38 are identical in cross section to the upper and lower frame members, in order to reduce inventory and production costs and it will be appreciated that the ends of the slats are received in recess 26, which as indicated above is dimensioned to receive 52,54,56 and 58 in sliding engagement. When erected it will be appreciated that the sides of the panel are held securely in sliding engagement with the side frame members which provide stiffening in a vertical plane for the panel, while the top and bottom of the panel are held in positive locking engagement with the top and bottom frame members. As each of the slats is also interlocked with its neighbour the total construction is particularly rigid and is believed capable of withstanding wind loads caused by winds in excess of 100 mph without blowing out of the frame. As a relatively massive frame section is employed and the slats are positively engaged therewith at least a portion of the strength of the sign is derived from the frame with the consequent advantage that the slats can be fabricated in a relatively light gauge material and extra stiffening ribs are not required.

I claim:

1. A display sign comprising:

(a) a rigid peripheral frame having a first channel extending around the inner periphery thereof;

(b) a plurality of parallel slats interconnected by curved hook means extending along their adjacent marginal edges and interlocking with adjacent hooks means to effectively prevent separation of the slats, the outer peripheral edge of said interconnected plurality of slats being slidably insertable into said channel; and (c) hook means interengaging the peripheral marginal edges of said interlocked slats, parallel the interlocked marginal edges thereof, with said channel, whereby lateral forces on the face of the sign are transferred from one slat to another and to the peripheral frame.

2. A display sign as claimed in claim 1 wherein said first channel in said frame includes means projecting therein for engagement with said hook means along said peripheral marginal edges of said interlocked slats.

3. A display sign comprising:

(a) a rigid peripheral frame having a first channel extending around the inner periphery thereof, said first channel including means projecting therein;

(b) a plurality of parallel slats each having a longitudinally extending second channel along each longitudinal marginal edge opening in a direction generally toward the opposite marginal edge, each interengaged with adjacent slats along by means of said longitudinally extending second channels, the outer peripheral edge of said interengaged slats projecting into said first channel of the peripheral frame and interengaged therewith, along the longitudinal marginal edges thereof, by said means projecting into said first channel; and (c) elongated removable means interlocking the longitudinal peripheral marginal edges of said interlocked slats against said means projecting into said first channel, whereby lateral forces on the face of the sign are transferred from one slat to another and to the peripheral frame.

4. A display sign as claimed in claim 3 including recess means in said first channel to receive said elongated removable means.

5. A display sign as claimed in claim 4 wherein said elongated removable means comprises a rigid rod means.

6. A display sign as claimed in claim 5 wherein said rod means is substantially circular in cross section, and said recess is semi-circular in cross section.

* * * * *